US007548490B2

(12) United States Patent
Snyder

(10) Patent No.: US 7,548,490 B2
(45) Date of Patent: Jun. 16, 2009

(54) TRANSDUCER TRANSOM ADAPTER

(76) Inventor: Ricky L. Snyder, 5602 Alben Ave., McFarland, WI (US) 53558

( * ) Notice: Subject to any disclaimer, the term of this patent is extended or adjusted under 35 U.S.C. 154(b) by 116 days.

(21) Appl. No.: 11/607,307

(22) Filed: Dec. 2, 2006

(65) Prior Publication Data

US 2008/0025149 A1 Jan. 31, 2008

Related U.S. Application Data

(60) Provisional application No. 60/832,940, filed on Jul. 25, 2006.

(51) Int. Cl.
*G10K 11/00* (2006.01)

(52) U.S. Cl. ..... 367/173

(58) Field of Classification Search ..... 367/165, 367/173

See application file for complete search history.

(56) References Cited

U.S. PATENT DOCUMENTS 3,752,431 A * 8/1973 McBride ..... 367/173
4,448,387 A * 5/1984 Gilbreath ..... 248/642
4,624,438 A 11/1986 Goodman, Jr.
4,907,208 A * 3/1990 Lowrance et al. ..... 367/173
5,016,225 A * 5/1991 Blomberg ..... 367/173
5,078,250 A * 1/1992 Cole ..... 193/35 R
5,109,364 A 4/1992 Stiner
5,186,428 A 2/1993 Falkenberg
5,425,003 A 6/1995 Horn
6,791,902 B1 9/2004 Steiner et al.
2008/0025149 A1 * 1/2008 Snyder ..... 367/173

* cited by examiner

*Primary Examiner*—Dan Pihulic

(57) ABSTRACT

An apparatus for releasably attaching a sonar transducer to a transom, the apparatus comprised of: a first support member; a second support member, a portion of which forms a U-shaped portion that is adapted to engage the transom; a length adjustment mechanism that allows for vertical translation of the first support member relative to the second support member; a locking mechanism that temporarily secures the first support member to the second support member; an anti-pivot member on the first support member adapted to temporarily prevent the apparatus from moving relative to said transom; and a mounting bracket also on the first support member and adapted to mount the sonar transducer thereon. The apparatus can further include one or more cable clips for securing an electric cable to the apparatus in which the cable electrically connects a remote power source to a sonar transducer.

19 Claims, 3 Drawing Sheets

TRANSDUCER TRANSOM ADAPTER

CROSS-REFERENCE TO RELATED APPLICATIONS

This application claims priority to U.S. provisional patent application Ser. No. 60/832,940, filed on Jul. 25, 2006 and incorporated herein in its entirety.

FIELD OF INVENTION

This invention relates generally to the field of marine devices and in particular to the field of a device that supports an adjustable marine acoustic transducer and sonar apparatus below the surface of the water when the apparatus is releasably attached onto the transom of a watercraft.

BACKGROUND

Marine acoustic transducers and sonar are used by recreational boaters and sport fishermen as aids to navigation and fishing as the transducers and sonar locate various underwater objects and schools of fish. In general terms, a transducer is a device, such as a piezoelectric crystal of photoelectric cell, that converts one form of input energy of another form into output energy of another. A marine acoustic transducer or sonar emits and captures sound waves reflected back to the transducer or sonar and converts the reflected sound waves into visual images of the surface of the water bottom or of fixed or moving objects, such as fish, located below the surface of the water and above the water bottom. These images are displayed on a device or apparatus for viewing.

Marine acoustic transducer or sonar systems that are used for recreational boating or sportfishing are comprised of a watertight pod or housing containing the sound emitting and capturing device (i.e., the marine acoustic transducer or sonar pod), a cable connecting the marine acoustic transducer or sonar pod to a power source (such as a marine battery or generator), and a video monitor or screen for viewing the images of the water bottom and underwater objects. The marine acoustic transducer or sonar pod is attached below the surface of the water to the hull of a watercraft, usually the transom, and the video monitor or screen is located on the bridge or section of the watercraft adjacent to operating and navigation controls.

The marine acoustic transducer or sonar pod is usually attached to the transom of a watercraft with threaded fasteners, screws, bolts, or the like, which necessitates drilling one or more holes into the transom or other section of the hull of a watercraft. This method of attachment suffers from several disadvantages. The holes bored into the transom or hull of the watercraft can cause water to leak into the inner cavity between the inner and outer transoms and hulls or otherwise damage the transom and hull of the watercraft. Furthermore, the marine acoustic transducer or sonar pod attached to the hull or transom of a watercraft is more or less permanently attached thereto. Relocation of the marine acoustic transducer or sonar pod is difficult and time consuming, requiring an additional set of holes to be drilled into the transom or hull of the watercraft and filling in the original set of drilled holes.

The instant invention thus introduces a transducer transom adapter that overcomes the aforementioned disadvantages of attaching, locating, or otherwise securing a marine acoustic transducer or sonar pod to the transom or hull of a watercraft. The adapter, with a marine acoustic transducer or sonar pod attached thereto, is releasably secured, affixed, or otherwise temporarily attached to the transom or hull of a watercraft to situate the marine acoustic transducer or sonar pod at an optimum location and orientation below the surface of the water. The adapter is fitted onto and over the transom of a watercraft and maintains the marine acoustic transducer or sonar pod at the optimum location and orientation below the surface of the water during varying speeds of the watercraft and water and environmental conditions. During non-use of the watercraft or marine acoustic transducer or sonar pod, the adapter with marine acoustic transducer or sonar pod attached thereto is simply lifted off the transom of the watercraft and stowed until subsequent use.

The existence of an adapter to releasably secure or attach a marine acoustic transducer or sonar pod to the transom or hull of a watercraft in the manner of the instant invention is unknown at the present time. For example, numerous designs for transducer transom adapters and other transom adapters and devices have been provided in the prior art. Even though these designs may be suitable for the specific individual purposes to which they address, they would not be suitable for the purposes of the present version of the invention as the transom adapters are elaborate in design and construction, consisting of a multitude of components and requiring one or more fasteners to be permanently attached or otherwise secured to the transom or hull of a watercraft. These designs are exemplified by the following patents:

U.S. Pat. No. 4,624,438, "Adjustable Outboard Transom," issued to Goodman, Jr. on 25 Nov. 1986 teaches an adjustable outboard transom having a pair of transom mount brackets bolted in spaced relationship to the transom and a pair of slotted motor mount brackets which support an outboard motor and cooperate with the transom mount brackets in sliding relationship, respectively, for vertical adjustment of the outboard motor. A shaft with a nut on one end rotatably connects the transom mount brackets and a pawl and ratchet mechanism cooperates with the shaft to facilitate incremental shaft rotation by applying a wrench to the nut. A pair of cable mounts secured to the motor mount brackets anchor each end of a cable which is wound around the shaft and bolts extend from the cable mounts through the slots in the transom mount brackets, respectively. Raising and lowering of the motor mount brackets and the outboard motor is facilitated by rotation of the shaft to selectively wind and unwind the cable on the shaft.

U.S. Pat. No. 4,907,208, "Sonar Transducer Assembly For Fishing Boats," issued to Lowrance et al. on 6 Mar. 1990 teaches a sonar transducer assembly for a fishing boat that provides electrical signals corresponding to an image of the area surrounding the boat on both sides thereof based on sound echoes received by the transducer assembly. The transducer assembly comprises a transducer housing mounted on the transom of the boat so that the bottom surface thereof is at substantially the level as the hull of the boat in the normal position of the transducer housing, and such that the transducer housing can move rearwardly and upwardly in response to hitting an object in the water. The housing is generally bullet-shaped and houses a plurality of individual transducers directed in different directions away from the hull of the boat so as to provide scanning of areas of the water beneath and on both sides of the boat.

U.S. Pat. No. 5,109,364, "Transducer For High Speed Boats," issued to Stiner on 28 Apr. 1992 teaches a sonar transducer assembly adapted to be mounted on the transom of a boat and includes a shaped transducer device comprising a housing, a mounting bracket assembly to be connected to the transom, a connector stem having a faired leading edge that connects the housing to the mounting bracket assembly, and a pivotable member that supports the transducer device. An elastomeric insert controls the force necessary to cause release of the connection to provide "kick-up" when the transducer device strikes an object in the water.

U.S. Pat. No. 5,186,428, "Depth Gauge Transducer Retractor Device," issued to Falkenberg on 16 Feb. 1993 teaches a retractor device for selectively positioning a depth gauge transducer into the water or retracting it to an upwardly facing position above the water line. A compound lever system allows for rotation of the transducer assembly.

U.S. Pat. No. 5,425,003, "Acoustic Transducer Mounting Clamp," issued to Horn on 13 Jun. 1995 teaches an acoustic transducer mounting clamp for holding an acoustic transducer against a test surface utilizing fatigue resistant adhesive and a gel couplant. A base and a holder formed to the base holds the acoustic transducer in contact with the test surface. The fatigue resistant adhesive maintains positioning of the acoustic transducer, and the gel couplant facilitates transmission of acoustic energy from the test surface to the acoustic transducer.

U.S. Pat. No. 6,791,902, "Portable Fish Finder," issued to Steiner et al. on 14 Sep. 2004 teaches a portable fish finder device with a housing that defines a wrap cavity for receiving a signal cable that communicates between a depth finder device and a transducer attached to the water craft. The depth finder device pivotally mounts to the housing to move between a storage position and an extended position. The cable winds into the wrap cavity for storage and unwinds when the depth finder is in use.

As illustrated by the background art, efforts are continuously being made in an attempt to develop devices for attaching a marine acoustic transducer, sonar pod, or other apparatus to the transom or hull of a watercraft. No prior effort, however, provides the benefits attendant with the present invention.

As such, it may be appreciated that there is a continuing need for a new and improved adapter for releasably attaching a marine acoustic transducer or sonar pod to the transom or hull of a watercraft. The adapter also permits the marine acoustic transducer or sonar pod to be easily detached from initial location of attachment at transom or hull for relocation on the transom or hull or for storage during non-use thereof. In these respects, the present version of the invention substantially departs from the conventional concepts and designs of the prior art, and in so doing provides an apparatus that substantially fulfills this need. Additionally, the prior patents and commercial techniques do not suggest the present inventive combination of component elements arranged and configured as disclosed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY

The present invention, which will be described in greater detail hereinafter with respect to several embodiments, relates to the field of marine acoustic transducers and sonar. More specifically, this version of the invention is concerned with an apparatus that supports a marine acoustic transducer and sonar below the surface of the water when the apparatus is releasably attached onto the transom of a watercraft.

Described briefly, according to one embodiment of the invention, a transducer transom adapter is releasably attached to the transom or hull of a watercraft. A marine acoustic transducer or sonar pod is affixed to the adapter so that the transducer or sonar pod is maintained at optimum depth and orientation below the surface of the water. The adapter can be easily detached from the initial location of attachment to the transom or hull for relocation on the transom or hull or for storage during non-use thereof.

In one embodiment, the adapter is comprised of elongated first and second support members that are releasably attached to each other and can be re-attached at various positions relative to each other to extend or retract the length of the adapter, i.e., an adjustment member. The first and second support members are each defined by respective first and second opposed ends and each contains a series of apertures. The second support member contains a first vertical section, a horizontal middle section, and a second vertical section. The first vertical section and the second vertical section each join with the horizontal section at approximately a right angle. A soft, resilient pad is located within the inside surfaces of the first vertical section, horizontal section, and a portion of the second vertical section of the second support member.

A suction cup and a plate are attached on opposite sides of the first support member at the second end thereof. An acoustic transducer support plate or transducer mounting bracket is attached to the rectangular plate on the side of the first support member opposite the suction cup. The third support member is comprised of a rectangular plate and an arm, which extends angularly from the rectangular plate of the third support member. First and second apertures are located within first and second opposed lateral sidewalls of the arm. In this embodiment, the third support member is the mounting bracket that is supplied with the transducer. It is not part of the invention and is referenced only to describe in greater detail one exemplary embodiment of how the transducer is attached to the adapter.

A marine acoustic transducer or sonar pod is attached to the arm, and power and image transmission cabling is attached at a first end thereof to the transducer or sonar pod secured within the arm. The cabling is received within clips located on the first and second support members and is attached at a second end to a remote power source and video or viewing monitor.

During use of the transducer transom adapter, a marine acoustic transducer or sonar pod and cabling are attached to the adapter as described supra. The adapter is fitted onto or over the transom of a watercraft by situating the second support member over the transom and lowering the adapter onto the transom until a cooperating section of the transom is received within the space formed by the first vertical section, the horizontal section, and the second vertical section of the second support member. The transom makes contact with the soft, resilient pad when the adapter is positioned upon the transom. The suction cup is then pressed to the waterside surface of the transom to affix the adapter in position onto the transom and relative to the watercraft. The adapter maintains the marine acoustic transducer or sonar pod at an optimum distance and orientation below the surface of the water over a wide range of watercraft velocity and water and environmental conditions. The adapter can be easily detached from its initial location of attachment to the transom or hull for relocation on the transom or hull, for use with another watercraft, or for storage during non-use thereof.

DRAWING REFERENCE NUMERALS

Figure 1:
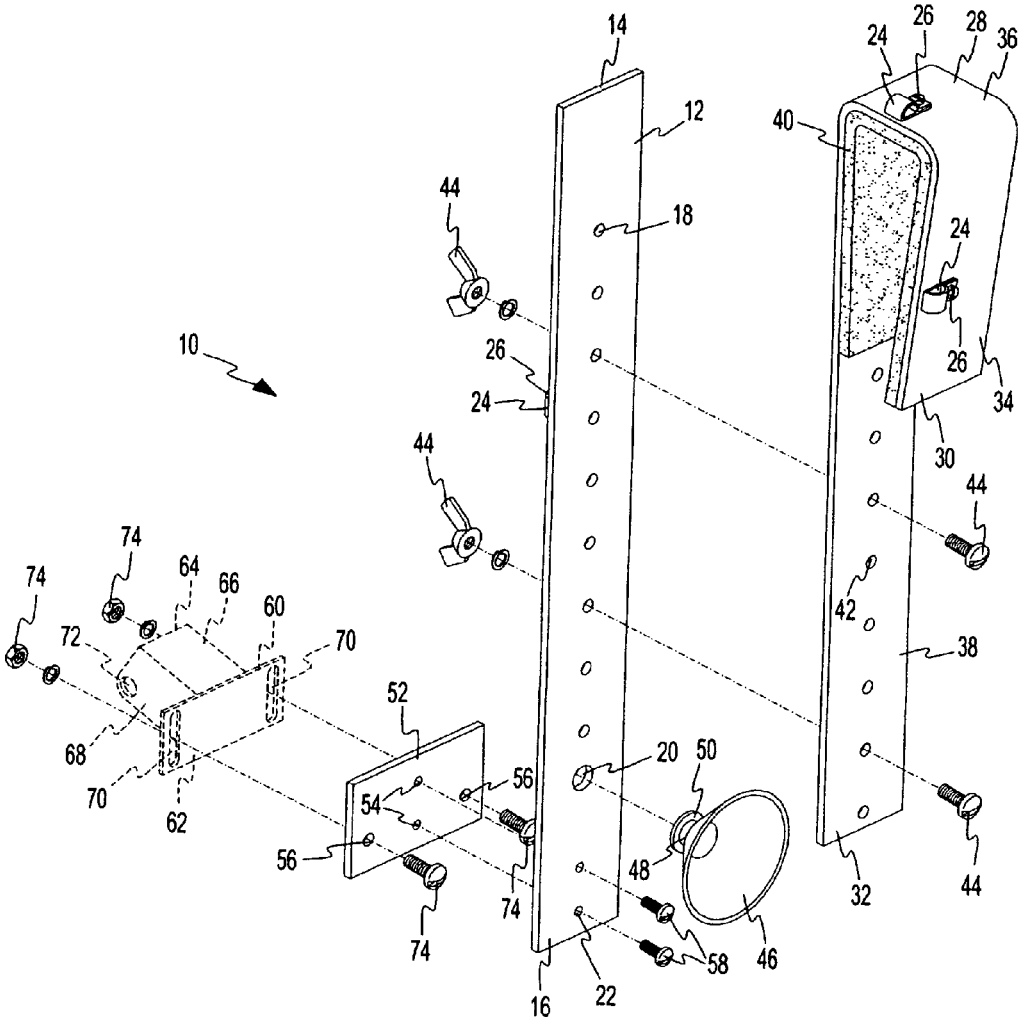
FIG. 1 is an exploded, top perspective view of one embodiment of the transducer transom adapter illustrating the constituent components thereof.

10 Transducer Transom Adapter
12 First Support Member
14 First End
16 Second end
18 Aperture
20 Aperture
22 Aperture
24 Cable Clip
26 Threaded Fastener
28 Second Support Member
30 First End
32 Second End
34 First Vertical Section
36 Horizontal Section
38 Second Vertical Section
40 Pad
42 Aperture
44 Threaded Fastener
46 Suction Cup
48 Shaft
50 Flange
52 Plate
54 Aperture
56 Aperture
58 Threaded Fastener
60 Acoustic Transducer Support
62 Plate
64 Arm
66 Top Sidewall
68 Lateral Sidewall
70 Aperture
72 Aperture
74 Threaded Fastener

DESCRIPTION OF EMBODIMENTS OF THE INVENTION

For the purpose of promoting an understanding of the present invention, references are made in the text hereof to embodiments of a transducer transom adapter. It should nevertheless be understood that no limitations on the scope of the invention are thereby intended. One of ordinary skill in the art will readily appreciate that modifications such as the size, materials, shape, form, assembly, and use, are deemed readily apparent and obvious to one skilled in the art, and all equivalent relationships to those illustrated in the drawings and described in the specification not depart from the spirit and scope of the present invention. Some of these possible modifications are mentioned in the following description. Therefore, specific details disclosed herein are not to be interpreted as limiting, but rather as a basis for the claims and as a representative basis for teaching one skilled in the art to employ the present invention in virtually any appropriately detailed system, structure, or manner.

It should be understood that the drawings are not necessarily to scale, emphasis instead being placed upon illustrating the principles of the invention. Moreover, the term "substantially" or "approximately" as used herein may be applied to modify any quantitative representation that could permissibly vary without resulting in a change in the basic function to which it is related and means about or roughly rather than an accurate quantification.

Referring now to the drawings and, in particular, to FIG. 1 in which there is illustrated, in exploded view, one embodiment of transducer transom adapter 10. The embodiment shown is comprised of an elongated first support member 12 that is bounded by first end 14 and an opposed, second end 16. A series of circular apertures 18 is located medially within first support member 12 in the majority portion thereof. In this embodiment, nine (9) apertures 18 are located within first support member 12 at one inch (1") intervals thereon. However, apertures 18 on first support member 12 can be at any increment therebetween. A single aperture 20 is also located within first support member 12 adjacent to the nine (9) apertures 18, and two (2) apertures 22 are located adjacent to the single aperture 20 in opposition to the nine (9) apertures 18. One (1) cable clip 24, with threaded fastener 26, is located on one (1) side of first support member 12, and clip 24 attached to first support member 12 by threaded fastener 26.

Second support member 28 is aligned for releasable attachment to first support member 12. Second support member 28 is bounded by first end 30 and an opposed, second end 32. Second support member 28 is further comprised of first vertical section 34, horizontal section 36, and second vertical section 38, forming substantially a U-shaped portion. First vertical section 34 and second vertical section 38 are each disposed at approximately a right angle to horizontal section 36. In the embodiment shown, first support member 12 and second support member 28 are each made of aluminum. However, first support member 12 and second support member 28 could alternately be made of wood, plastic, steel or other metal, or any other sufficiently durable and corrosion-resistant material, including combinations thereof.

A soft, resilient pad 40 is attached to an inner portion of second support member 28 and extends from first end 30 thereof, over the inside surface of first vertical section 34, horizontal section 36, and to a portion of second vertical section 38 commensurate in length to the opposed first vertical section 34. Cable clip 24 is located on first vertical section 34 of second support member 28, and another cable clip 24 is located on horizontal section 36 of second support member 28, each secured thereto by threaded fastener 26. In the embodiment shown, pad 40 is made of a heavy duty felt adhered to the inside of second support member 28 by a self-sticking adhesive. However, in alternate embodiments, pad 40 can instead of made of an indoor/outdoor carpet, extruded polystyrene foam, rubber, or any other material capable of providing a layer between transducer transom adapter 10 and the transom and minimizing vibrations, including combinations thereof and adhered to second support member 28 by any means or mechanism known in the art.

A series of circular apertures 42 is located medially within second vertical section 38 of second support member 28. In this embodiment, there are eight (8) apertures 42 at one inch (1") intervals to correspond with apertures 18 on first support member 12. However, as with apertures 18 on first support member 12, apertures 42 on second support member 28 can be at any increment therebetween that correspond with apertures 18 on first support member 12. Two (2) threaded fasteners 44 are aligned for insertion through apertures 42 of second support member 28 and cooperating apertures 18 of first support member 12 to attach first support member 12 and second support member 28 to each other. Threaded fasteners 44, in conjunction with apertures 18, 42, allow the length of transducer transom adapter 10 to be adjusted through vertical translation of first support member 12 relative to second support member 28.

In the embodiment shown, threaded fasteners 44 are each a wing nut, a bolt, and a washer. This combination allows for the positioning of first support member 12 relative to second support member 28 without the need of tools, is very effective, and minimizes vibration noise. It should be understood that any temporary locking mechanism, adapted to removably secure first support member 12 to second support member 28, can alternately be employed. Other examples of a temporary fastener include, but are not limited to, a bolt and nut, a pin and a cotter key, a clevis pin, a detent ring pin, a lanyard, a lock pin, a split key ring, a double loop hair pin, a circle cotter, a kickout ring, a lynch pin, a crimp ring retainer, a spring ball plunger, a ball plunger, a 16-18 gauge wire weaved in and out of apertures 18 on first support member 12 and apertures 42 on second support member 28, or any other temporary fastener known in the art, including combinations thereof. Moreover, transducer transom adaptor is shown with the U-shaped portion facing the forward end of the watercraft. Second support member 28 is therefore forward of first support member 12. It should be understood that first support member 12 could be positioned forward of second support member 28 with the remaining components identically positioned.

In addition, as stated supra, the use of threaded fasteners 44 in conjunction with apertures 18, 42 allows the length of transducer transom adapter 10 to be adjusted through vertical translation of first support member 12 relative to second support member 28. However, this is only one (1) type of a length adjustment mechanism. One of ordinary skill in the art will recognize that other types of length adjustment mechanism commonly known and used in the art could alternatively be employed, Also visible in FIG. 1 is one embodiment of an anti-pivot member which prevents transducer transom adaptor 10 from pivoting about the U-shaped portion. In the embodiment shown, the anti-pivot member is suction cup 46 with rear shaft 48 and flange 50 attached to end of shaft 48 is aligned for insertion of flange 50 and shaft 48 through the circular aperture 20 of the first support member 12 with the shaft 48 occupying the aperture 20. Flange 50 attached to shaft 48 secures suction cup 46 to first support member 12. Suction cup 46 stabilizes transducer transom adaptor 10 and minimizes any Doppler effects created by second end 16 of first support member 12 pivoting or swinging. Suction cup 46 is made of an elastomeric material or any other material commonly known and used in the art.

Referring again to FIG. 1, rectangular plate 52 is aligned for attachment to first support member 12 proximate to second end 16 of first support member 12. Plate 52 contains two apertures 54 located medially therein and first and second apertures 56 flanking apertures 54. Threaded fasteners 58 are each aligned for insertion into apertures 22 of first support member 12 and medial apertures 54 of plate 52 to attach plate 52 to first support member 12. Acoustic transducer support 60 is aligned for attachment to rectangular plate 52. In this embodiment of acoustic transducer support 60, acoustic transducer support 60 is the mounting bracket to which the transducer (not shown) is attached. As provided supra, acoustic transducer support 60 is not part of transducer transom adapter 10 and is referenced only to describe how the transducer is attached to transducer transom adapter 10. Acoustic transducer support 60 (shown in phantom line) is comprised of a flat, rectangular plate 62 and arm 64, arm 64 attached to plate 62 and extending therefrom. Arm 64 is comprised of top sidewall 66 and first and second, opposed lateral sidewalls 68 (See FIG. 3). Elongated apertures 70 are located at opposed ends of rectangular plate 62, and circular apertures 72 are located at rounded corners of each lateral sidewall 68 of arm 64. Apertures 70 are elongated to one half inch (½") which allows for even more precise positioning of the transducer. Threaded fasteners 74 are aligned for inserting into apertures 56 of rectangular plate 52 and corresponding apertures 70 of flat rectangular plate 62 of acoustic transducer support 60 to attach acoustic transducer support 60 to rectangular plate 52 and first support member 12. In an alternate embodiment, rectangular plate 52 can be welded to second end 16 of first support member 12 directly, which is permanent, or second end 16 of first support member 12 can further include rectangular plate 52, which would not require any additional step of securing, permanently or temporarily, rectangular plate 52 to first support member 12. Rectangular plate 52, whether permanently attached to first support member 12, temporarily attached to first support member 12, or integrated with first support member 12 provides an point for acoustic transducer support 60 and the transducer to be attached to transducer transom adapter 10.

Figure 2:
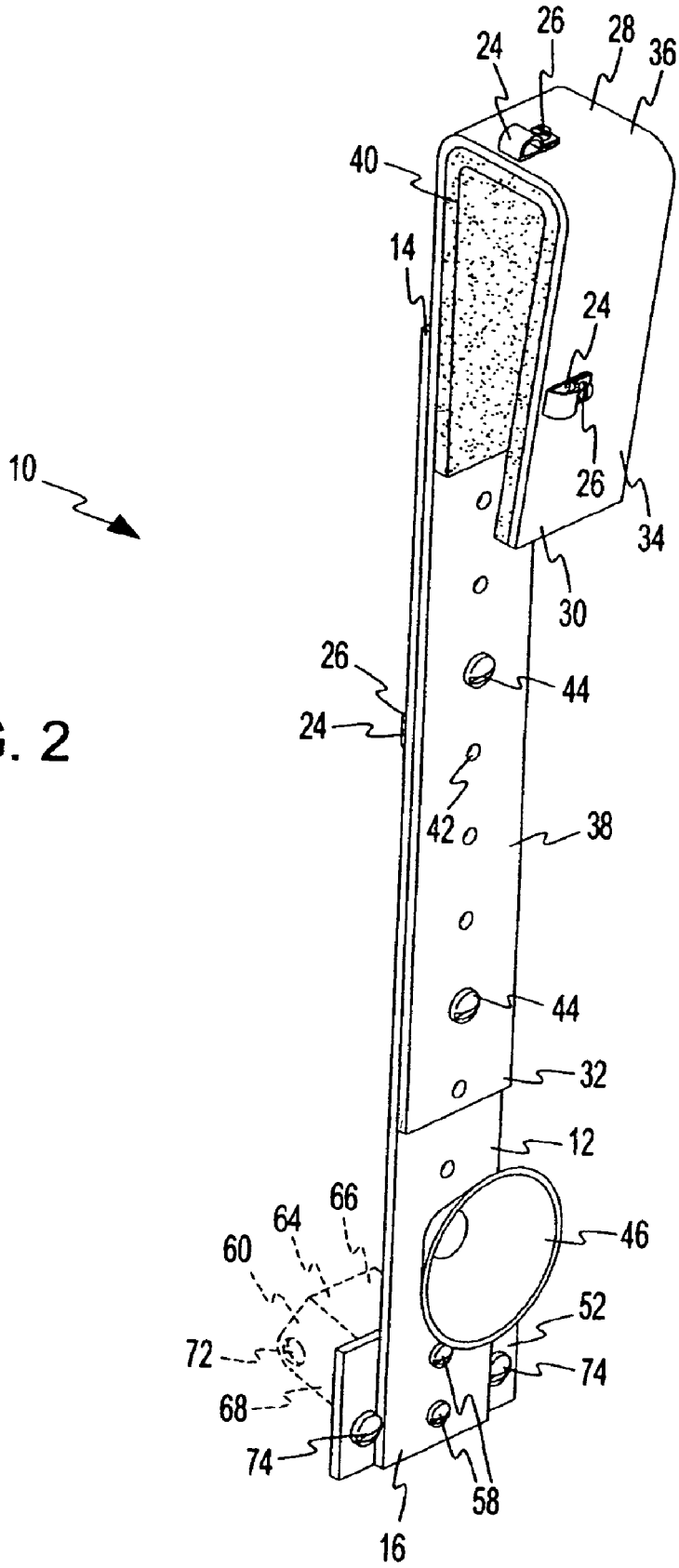
FIG. 2 is a first top perspective view of the embodiment of the transducer transom adapter shown in FIG. 1 in an assembled configuration.
Figure 3:
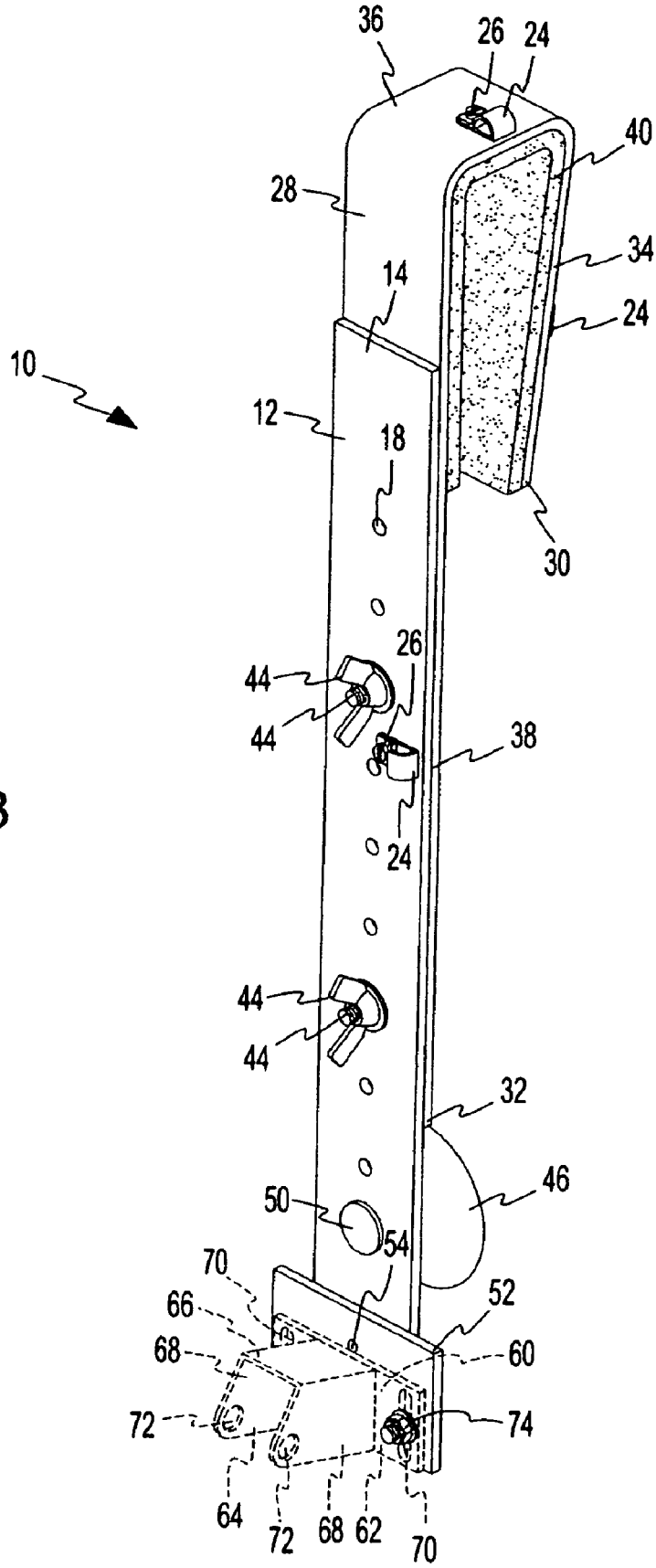
FIG. 3 is a second top perspective view of the embodiment of the transducer transom adapter shown in FIG. 1 in an assembled configuration.

FIG. 2 and FIG. 3 each show top perspective views of the embodiment of transducer transom adapter 10 shown in FIG. 1 in an assembled configuration. Threaded fasteners 44 occupy apertures 42 of second support member 28 and corresponding apertures 18 of first support member 12 to attach the support members 12, 28 to each other 12, 28. The length of transducer transom adapter 10 can be adjusted by vertically extending or retracting first support member 12 and second support member 28 with respect to each other and aligning first and second support members 12, 28 over respective apertures 18, 42 when a suitable length of transducer transom adapter 10 has been selected. Threaded fasteners 44 can be inserted into respective, cooperating apertures 18, 42 of first support member 12 and second support member 28 to attach first and second support members 12, 28 to each other 12, 28 and maintain transducer transom adapter 10 at the selected length. The embodiment of transducer transom adapter 10 shown can extend to approximately twenty-four inches (24") and retract to approximately fourteen inches (14") in length. Suction cap 46 and rectangular plate 52 are attached to first support member 12 as described previously, and arm 64 is attached to rectangular plate 52 as described supra.

A marine acoustic transducer or sonar pod or module (not shown) is attached to arm 64, which is affixed to first support member 12 of transducer transom adapter 10 before transducer transom adapter 10 is attached to the transom of a watercraft. A threaded fastener, pin, rod, or similar device (not shown) that is used to secure the marine acoustic transducer or sonar module to a support surface or component is inserted into aperture(s) 72 of one or both of lateral sidewall(s) 68 of arm 64 of acoustic transducer support 60. The marine acoustic transducer or sonar module can be secured to arm 64 in frictional engagement in a single, fixed position or pivotally attached to arm 64 so that the marine acoustic transducer or sonar module can rotate within aperture(s) 70 of one or both of lateral sidewall(s) 68 of arm 64. A power and image transmission cable (not shown) is connected at a first end to the marine acoustic transducer or sonar module and is inserted within cable clips 24 to secure the cable to transducer transom adapter 10. The cable is affixed in place within clips 24 by threaded fasteners 26 securing clips 24 to first support member 12 and second support member 28. The second end of the cable can be connected to various power and imaging components, such as a marine battery, video monitor, viewing screen, and the like.

Transducer transom adapter 10, with marine acoustic transducer or sonar module and cable secured thereon, is releasably attached to the transom (not shown) of a watercraft by positioning transducer transom adapter 10 over the transom with suction cup 46 facing the outside or water side surface of the transom. Transducer transom adapter 10 is lowered over the transom until a corresponding section of the transom is received by second support member 28, specifically the U-shaped portion formed by the inside surfaces of first vertical section 34, horizontal section 36, and second vertical section 38. Resilient pad 40 makes contact with corresponding surfaces of the transom and functions to absorb shocks or impacts and to prevent transducer transom adapter 10 from sliding or slipping off the transom during use. Transducer transom adapter 10 is further secured to the transom by the angle of first vertical section 34 of second support member 28, which is disposed toward the third section 38 at a slight angle. The angle creates a snug fit between the U-shaped portion of second support member 28 and the transom. In the embodiment shown, first vertical section 34 is angled approximately ten degrees (10°) inward from vertical, but can be at another angle or vertical. In this manner, transducer transom adapter 10 exerts pressure upon the transom at or proximate to first end 30 of second support member 28 and at a corresponding section of second vertical section 38 of second support member 28. Once the transom is fully received within pad 40, suction cup 46 can be pressed to a corresponding surface of the transom to secure transducer transom adapter 10 to the transom. Arm 64, with marine acoustic transducer or sonar module attached thereon, is submerged below the surface of the water when transducer transom adapter 10 is attached to the transom as described.

During use of the watercraft, transducer transom adapter 10 maintains the marine acoustic transducer or sonar module at an optimum position and angle below the surface of the water for sonar detection and readings. Transducer transom adapter 10 will remain in fixed attachment to the watercraft during various speeds of the watercraft and varying water and environmental conditions. As necessary, transducer transom adapter 10 can be adjusted in length by extending or retracting the first 12 and second 28 support members with respect to each other 12, 28 in the manner as referenced previously in this disclosure to adapt to particular environmental conditions or watercraft configuration. During non-use, transducer transom adapter 10 can easily be detached from the transom of the watercraft by disengaging it from the transom at suction cup 46 and lifting off the transom.

While the transducer transom adapter has been shown and described with respect to several embodiments in accordance with the present invention, it is to be understood that the same is not limited thereto, but is susceptible to numerous changes and modifications as known to a person skilled in the art, and it is intended that the present invention not be limited to the details shown and described herein, but rather cover all such changes and modifications obvious to one of ordinary skill in the art.

What is claimed is:

1. An apparatus for releasably attaching a sonar transducer to a transom, said apparatus comprised of:

a first flat, rectangular plate support member, said first flat, rectangular plate support member comprised of a first end and a second end;

a second flat, rectangular plate support member, said second flat, rectangular plate support member comprised of a first vertical section, a horizontal section, and a second vertical section, said first vertical section, said second vertical section, and said horizontal section forming a substantially U-shaped portion, said U-shaped portion adapted to engage said transom;

a pad positioned within said U-shaped portion;

a plurality of cable clips adapted to secure an electric cable wherein said electric cable is secured to said first flat, rectangular plate and second flat, rectangular plate at at least three points and said electric cable is directly in contact with water when the boat is afloat;

a length adjustment mechanism; said adjustment mechanism allowing for vertical translation of said first flat, rectangular plate support member relative to said second flat rectangular plate support member;

a locking mechanism, said locking mechanism temporarily securing said first flat rectangular plate support member to said second flat, rectangular plate support member;

a suction cup disposed on said second end of said first flat, rectangular plate support member wherein said suction cup is positioned below the surface of the water and adapted to temporarily prevent said apparatus from moving relative to said transom; and a mounting bracket disposed on said second end of said first flat, rectangular plate support member and adapted to mount said sonar transducer thereon.

2. The apparatus of claim 1, wherein said length adjustment mechanism is comprised of a first plurality of apertures disposed on said first flat, rectangular plate support member, a second plurality of apertures disposed on said second vertical section of said second flat, rectangular plate support member, and said locking mechanism passing therebetween.

3. The apparatus of claim 1, wherein said locking mechanism is a plurality of threaded bolts and a wing nut threadily engaging each of said plurality of threaded bolts.

4. The apparatus of claim 1, wherein said electric cable is attached on a first end to a remote power source and on a second end to said sonar transducer.

5. The apparatus of claim 1, wherein said pad is selected from a group consisting of felt, indoor/outdoor carpet, extruded polystyrene foam and rubber.

6. An apparatus for releasably attaching a sonar transducer to a transom, said apparatus comprised of:

a first flat, rectangular plate support member, said first flat, rectangular plate support member comprised of a first end, a second end, and a first plurality of apertures disposed thereon;

a second flat, rectangular plate support member, said second flat, rectangular plate support member comprised of a first vertical section, a horizontal section, a second vertical section, and a second plurality of apertures disposed thereon, said first vertical section, said second vertical section, and said horizontal section forming a substantially U-shaped portion, said U-shaped portion adapted to engage said transom;

a pad positioned within said U-shaped portion;

a locking mechanism, said locking mechanism passing through at least one of said first plurality of apertures and at least one of said second plurality of apertures to temporarily secure said first flat, rectangular plate support member to said second flat, rectangular plate support member and allowing for vertical translation of said first flat, rectangular plate support member relative to said second flat, rectangular plate support member;

a suction cup disposed on said second end of said first flat, rectangular plate support member wherein said suction cup is positioned below the surface of the water and adapted to temporarily prevent said apparatus from moving relative to said transom; and a mounting bracket disposed on said second end of said first flat, rectangular plate support member and adapted to mount said sonar transducer thereon.

7. The apparatus of claim 6, wherein said locking mechanism is at least one threaded bolt and a wing nut threadily engaging each of said plurality of threaded bolts.

8. The apparatus of claim 6, wherein said apparatus is further comprised of at least one cable clip, said at least one cable clip adapted to secure an electric cable to said apparatus.

9. The apparatus of claim 8, wherein said electric cable is attached on a first end to a remote power source and on a second end to said sonar transducer.

10. The apparatus of claim 6, wherein said pad is selected from a group consisting of felt, indoor/outdoor carpet, extruded polystyrene foam and rubber.

11. An apparatus for releasably attaching a sonar transducer to a transom, said apparatus comprised of:

a first flat, rectangular plate support member, said first flat, rectangular plate support member comprised of a first end, a second end, and a first plurality of apertures disposed thereon;

a second flat, rectangular plate support member, said second flat, rectangular plate support member comprised of a first vertical section, a horizontal section, a second vertical section, and a second plurality of apertures disposed thereon, said first vertical section, said second vertical section, and said horizontal section forming a substantially U-shaped portion, said U-shaped portion adapted to engage said transom;

a pad positioned within said U-shaped portion;

a locking mechanism, said locking mechanism passing through at least one of said first plurality of apertures and at least one of said second plurality of apertures to temporarily secure said first flat, rectangular plate support member to said second flat, rectangular plate support member and allowing for vertical translation of said first flat, rectangular plate support member relative to said second flat, rectangular plate support member;

a suction cup disposed on said second end of said first flat, rectangular plate support member wherein said suction cup is positioned below the surface of the water and adapted to temporarily prevent said apparatus from moving relative to said transom; and a mounting bracket disposed on said second end of said first flat, rectangular plate support member and adapted to mount said sonar transducer thereon.

12. The apparatus of claim 11, wherein said locking mechanism is at least one threaded bolt and a wing nut threadily engaging each of said plurality of threaded bolts.

13. The apparatus of claim 11, wherein said apparatus is further comprised of at least one cable clip, said at least one cable clip adapted to secure an electric cable to said apparatus.

14. The apparatus of claim 13, wherein said electric cable is attached on a first end to a remote power source and on a second end to said sonar transducer.

15. The apparatus of claim 11, wherein said pad is selected from a group consisting of felt, indoor/outdoor carpet, extruded polystyrene foam and rubber.

16. An apparatus for releasably attaching a sonar transducer to a transom, said apparatus comprised of:

a first flat, rectangular plate support member, said first flat, rectangular plate support member comprised of a first end, a second end, and a first plurality of apertures disposed thereon;

a second flat, rectangular support member, said second flat, rectangular plate support member comprised of a first vertical section, a horizontal section, a second vertical section, and a second plurality of apertures disposed thereon, said first vertical section, said second vertical section, and said horizontal section forming a substantially U-shaped portion, said U-shaped portion adapted to engage said transom;

a pad positioned within said U-shaped portion;

at least one threaded bolt and a wing nut threadily engaging each of said at least one threaded bolt, each of said at least one threaded bolt passing through one of said first plurality of apertures and one of said second plurality of apertures to temporarily secure said first flat, rectangular plate support member to said second flat, rectangular plate support member and allowing for vertical translation of said first flat, rectangular plate support member relative to said second flat, rectangular plate support member;

a suction cup disposed on said second end of said first flat, rectangular plate support member wherein said suction cup is positioned below the surface of the water and adapted to temporarily prevent said apparatus from moving relative to said transom; and a mounting bracket disposed on said second end of said first flat, rectangular plate support member and adapted to mount said sonar transducer thereon.

17. The apparatus of claim 16, wherein said apparatus is further comprised of at least one cable clip, said at least one cable clip adapted to secure an electric cable to said apparatus.

18. The apparatus of claim 16, wherein said apparatus is further comprised of an electric cable, wherein said electric cable is attached on a first end to a remote power source and on a second end to said sonar transducer.

19. An apparatus comprised of:

a watercraft, said watercraft having a transom positioned rearward of said watercraft;

a sonar transducer electrically connected to said watercraft; and an apparatus for releasably attaching said sonar transducer to said transom, said apparatus comprised of:

a first flat, rectangular plate support member, said first flat, rectangular plate support member comprised of a first end and a second end;

a second flat, rectangular plate support member, said second flat, rectangular plate support member comprised of a first vertical section, a horizontal section, a second vertical section, and a second plurality of apertures disposed thereon, said first vertical section, said second vertical section, and said horizontal section forming a substantially U-shaped portion, said U-shaped portion adapted to engage said transom;

a pad positioned within said U-shaped portion;

a locking mechanism, said locking mechanism passing through at least one of said first plurality of apertures and at least one of said second plurality of apertures to temporarily secure said first flat, rectangular plate support member to said second flat, rectangular plate support member and allowing for vertical translation of said first flat, rectangular plate support member relative to said second flat, rectangular plate support member;

a suction cup disposed on said second end of said first flat, rectangular plate support member wherein said suction cup is positioned below the surface of the water and adapted to temporarily prevent said apparatus from moving relative to said transom; and a mounting bracket disposed on said second end of said first flat, rectangular plate support member and adapted to mount said sonar transducer thereon.

* * * * *